United States Patent [19]

Garde

[11] Patent Number: 5,015,500

[45] Date of Patent: May 14, 1991

[54] ROLL COATER WITH PERFORATED DECKLES

[75] Inventor: Gerald R. Garde, Beloit, Wis.

[73] Assignee: Beloit Corporation, Beloit, Wis.

[21] Appl. No.: 437,416

[22] Filed: Nov. 16, 1989

[51] Int. Cl.[5] ..... B05D 1/28

[52] U.S. Cl. ..... 427/211; 118/244; 118/126; 118/602

[58] Field of Search ..... 427/211; 118/410, 126, 118/244, 258, 602

[56] References Cited

U.S. PATENT DOCUMENTS

| | | | |
|---|---|---|---|
| Re. 31,695 | 10/1984 | Zink | 118/122 |
| 890,221 | 6/1908 | Davidson et al. | 118/413 |
| 2,015,531 | 9/1935 | Montgomery | 91/48 |
| 2,918,899 | 12/1959 | Munton et al. | 118/413 |
| 3,080,847 | 3/1963 | Justus | 118/126 |
| 4,426,412 | 1/1984 | Gebert et al. | 118/410 X |
| 4,836,133 | 6/1989 | Wohrle | 118/410 |
| 4,852,514 | 8/1989 | Wohrle | 118/410 |

*Primary Examiner*—Shrive P. Beck
*Assistant Examiner*—Alain Bashore
*Attorney, Agent, or Firm*—Dirk J. Veneman; Raymond W. Campbell; Gerald A. Mathews

[57] ABSTRACT

Apparatus for maintaining a relatively placid pool of liquid coating material in the trough between two nipped rolls comprises a pair of deckles, one disposed near either end of the nipped rolls, each of the deckles having an edge generally conforming to a segment of the adjacent roll to effectively form an end of the trough formed by the rolls. At least one of the deckles has one or more openings which permit the liquid coating material to flow laterally out of the trough and through the deckle at a rate proportional to the depth of the coating material in the trough. Controlling the lateral outward flow of material from the trough stabilizes both the turbulence of the liquid coating material in the trough and the surface condition of the coating material.

8 Claims, 2 Drawing Sheets

ROLL COATER WITH PERFORATED DECKLES

BACKGROUND OF THE INVENTION

1. Field of the Invention

This invention relates to the coating of a traveling paper web. More specifically, this invention relates to apparatus for controlling the depth and turbulence of the pool of liquid coating material in the trough between two nipped rolls in a roll-type coater. Still more specifically, this invention relates to a unique design of an end deckle having one or more openings which permit the outward flow of liquid coating material through the deckle as a function of the depth of the material in the trough between the nipped rolls.

2. Description of the Prior Art

Roll-type coaters, which utilize a plurality of nipped rolls to meter coating material applied to either the surface of one or more of the rolls or to a trough formed between nipped rolls, have been known for a long time. Also known is the use of end deckles in coaters to form a trough with the surfaces of the rolls to maintain a pool of liquid coating material between the nipped rolls. Sometimes, a paper web is run through a pool of the coating material in a trough between nipped rolls, and sometimes the web is run between other nipped rolls while the trough supplies coating material to the surface of a roll which is, in turn, nipped with a roll which nips the web such that the coating material is metered before contacting the web.

As long as the pool of coating material is relatively viscous, and the speeds of the nipped rolls forming the trough for the pool of coating material are relatively slow, or the pool of coating material is relatively shallow, or some combination of these operating conditions are present, problems regarding coating material pool turbulence and skipping of the coating material at certain locations on the web are not significant or can be controlled by simply supplying more coating material to the trough. However, even having deeper pools in the troughs does not necessarily solve all the problems as machine speeds are increased. A pool of coating material has two interfaces with the downwardly rotating metering rolls. The coating liquid at and near the interfaces tends to travel in the downwardly direction with the roll surfaces. Since all of the interface portion of the pool cannot pass through the nip, some of the coating liquid is forced back upwardly in the inner portion of the pool to erupt from the surface and splash about.

This problem could be alleviated by slowing the machine speed. However, to be economically competitive, the coating operation, like other aspects of papermaking, has to be done faster than before, but with the same or improved quality. In addition, more types of paper are being coated than ever before, and there are more lighter grade papers being coated with less viscous, almost water-like coatings, such as starch used to coat newsprint to reduce subsequent dusting problems in the printing operations.

If less viscous coating compositions are used in prior roll coating apparatus and the coating apparatus is operated at higher speeds, or if the depth of the pool of coating material is increased, or some combination of these operating parameters are present, the pool of coating liquid becomes increasingly agitated and turbulence develops. The turbulence in the coating pool can become so great that the coating material begins to erupt and shift, which has several undesirable consequences, such as wasting the heated coating material; splashing on previously coated paper or uncoated paper; creating such deep depressions in the pool that streaks of uncoated, or non-uniformly coated areas of the paper web develop. Naturally, none of these results are desirable, but some of them produce defects in the paper so great that the paper can either not be sold, or must be sold at a discounted price. Some grades which must be of superior quality are papers intended to be laser printed and computer paper grades.

SUMMARY OF THE INVENTION

The aforementioned problems associated with operating roll-type coaters, particularly those utilizing less viscous coating materials at high speeds, such as about 4000 feet per minute, or above, have been mitigated by this invention. One, or preferably both, of the end deckles used to maintain the pool of liquid coating material in the roll coater is provided with one or more openings through the deckle, which opening, or openings, extend generally vertically so as to permit increasing amounts of the coating liquid to flow out of the openings as the depth of the coating material in the trough increases. This creates a controlled current in the pool and allows the laterally outwardly directional flow of the coating liquid to be maintained in a relatively deep pool of coating material. It also stabilizes the pool surface and reduces turbulence in the pool caused by the tendency of the outer portions of a stagnant pool of coating to try to pass through the nip between the co-running rolls forming the side walls of the trough holding the coating material. Finally, by increasing the flow of liquid out of the pool of coating material from the ends of the trough, the average depth of the pool in the cross-machine direction along the surfaces of the metering rolls becomes more uniform, thereby providing greater coating uniformity at the higher speeds permitted by the greater pool depth.

Accordingly, from an operational standpoint, the depth of the pool of coating material can be maintained at a greater depth while decreasing its turbulence, even when the pool is filled with low viscosity coating liquids. This results in pools in the troughs of roll coaters having few, if any, voids, particularly at high speeds, so the paper web is more uniformly coated.

The openings in the end deckles preferably comprise a plurality of generally vertically arrayed holes. The openings provide increased lateral flow of the coating material out of the pool proportional to the depth of the pool with the characteristics and advantages described above. The openings also permit lateral flow from all depths of the coating pool, or only from the upper depths, as desired.

Accordingly, it is an object of this invention to provide an improved end deckle for a paper web roll-type coater.

Another object of this invention is to provide an improved end deckle having perforations for permitting increased flow of coating material from the pool of material in the trough of a roll-type paper web coater.

Still another object of this invention is to provide an apparatus and method for controlling the turbulence of low viscosity coating liquids in a roll-type paper web coater.

A feature of this invention is end deckles having one or more openings, or a pattern of openings, to permit the passage of liquid coating material from one side of the deckle to the other.

An advantage of this invention is to permit faster speeds in a roll coater while maintaining high quality and uniformity in the application of coating to the paper web.

These, and other objects, features and advantages of this invention will become more readily apparent to those skilled in the art upon reading the following description of the preferred embodiment in conjunction with the attached drawings.

DESCRIPTION OF THE PREFERRED EMBODIMENT

Figure 1:
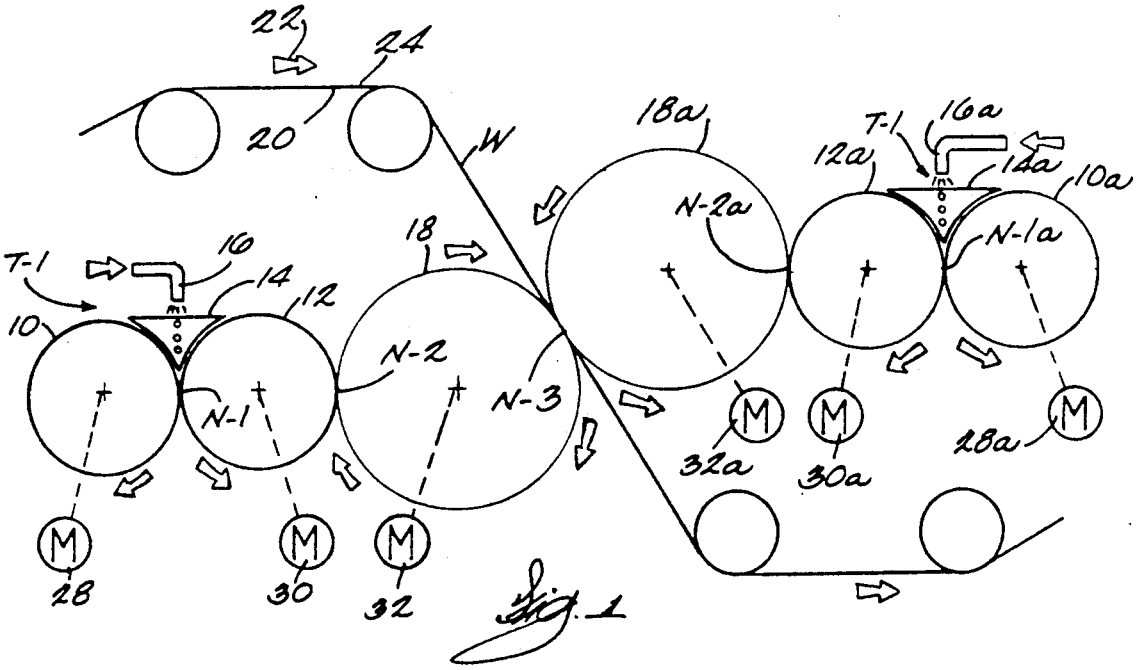
FIG. 1 is a schematic, side-elevational view of a roll coater showing two pairs of metering rolls, and showing the perforated end dam on one end of the trough formed between each pair of metering rolls.

A roll coater, such as shown in FIG. 1, comprises a plurality of nipped rolls which are supplied with a quantity of liquid coating material in a pool contained in a trough formed between two rolls and a pair of end deckles in one or more of the nips between rolls, generally the nips at the outer extremities of the apparatus. The metering rolls passing through the pool of coating carry the coating on their surface to the next nip with an adjacent roll where the coating is metered onto the next roll which then carries it into another nip through which the paper web is passed to coat the web with an even layer of coating. This type of coater is sometimes known as a Gate Roll Coater.

In this application, corresponding elements will be correspondingly numbered except for a letter suffix to distinguish between like elements, and a prime mark to distinguish different groups of like elements. Similarly, since the apparatus shown in FIG. 1 is essentially symmetrical, the structure relating to the coating of the upper surface of the web, and its operation, will be the same, so the detailed description will only be directed to the structure and operation regarding the coating of the lower surface of the traveling paper web. Similarly, the manner of driving the individual rolls is well-known to those skilled in the art and does not per se form part of this invention, so such roll driving arrangements will not be shown or described in detail, but will instead be shown schematically and described in general terms.

Thus, with reference to FIG. 1, metering rolls 10,12 form a nip N-1. The sides of rolls 10,12, nip N-1 and a pair of end deckles 14,14*a*, only one of which is shown in FIG. 1, form a trough which is generally designated T-1. A supply of liquid coating material, such as an aqueous slurry of starch, is introduced into the trough to form a pool of coating material from one or more nozzles 16,16*a*,16*b*.

Metering roll 12 nips applicator roll 18 and coats the surface thereof with a thinner layer of coating which is transferred to the lower side 20 of web W traveling in the direction of arrow 22 the upper side 24 of web W is coated by the apparatus on the other side of applicator roll 18*a*.

Rolls 10,12 are nipped together at nip N-1 which might typically be about 50–125 pli (pounds per lineal inch). Rolls 10,12 rotate in the direction of the arrows shown, but at different speeds which is possible due to the lubricating quality of the liquid coating material passing through nip N-1. This speed differential helps meter the coating over the surface of roll 12 which is nipped with applicator roll 18. Thus, motor 28 might rotate roll 10 at a surface speed of about 300–800 fpm, and motor 30 might rotate roll 12 at a surface speed of about 1250–1800 fpm.

Similarly, nips N-1*a* and N-2*a* might be about 50–125 pli, and motors 28*a*,30*a* might rotate rolls 10*a*,12*a* at surface speeds of about 300–800 fpm and 1250–1800 fpm, respectively.

The different roll speeds, and the speed differentials between the nipped rolls, are provided by independently controlling the speeds of motors 28 and 30. Thus, in broad terms, roll 10 is capable of variable speeds which are 25%–100% of the paper web speed, and roll 12 is capable of variable speeds which are 50%–100% of the paper web speed.

Since the web W, having upper and lower surfaces 24,20 respectively, passes through nip N-3. there is no speed differential between the speed of the web and the surface speed of rolls 18,18*a* driven by motors 32,32*a*, respectively. A typical speed of the web W through applicator rolls 18,18*a* might be about 1500–5000 fpm.

Figure 2:
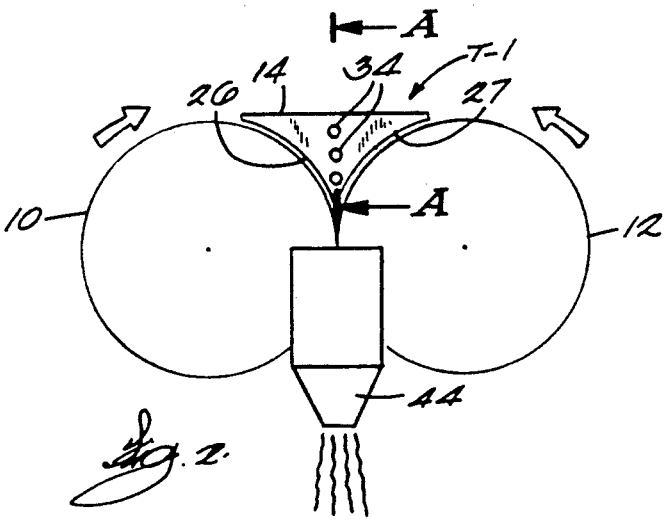
FIG. 2 is an enlarged side-elevational view of a pair of metering rolls shown in FIG. 1, and showing the perforated end deckle and edge pan.

With reference to FIG. 2, rolls 10,12 form the sides of a trough T-1 extending longitudinally for substantially the length of the rolls. At either end of the rolls, a plate-like deckle 14,14*a*, each having parallel front and back surfaces 15,17, respectively, and each having edges 26,27 contoured to correspond with the curvature of the surface of rolls 10,12, is disposed to close the trough formed between the rolls. Contoured edges 26,27 do not necessarily touch the surfaces of rolls 10,12, but are mounted in such closely spaced adjacency that they effectively seal the trough over the roll surfaces. The trough, generally designated with numeral T-1, thus has four sides defined by the surfaces of rolls 10,12 and the inner surfaces of end deckles 14,14*a*.

Figure 5A:
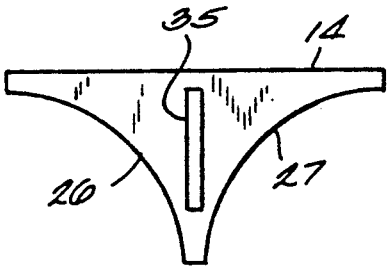
FIGS. 5*a*,5*b* are side-elevational views of the deckles showing different configurations for the openings.
Figure 5B:
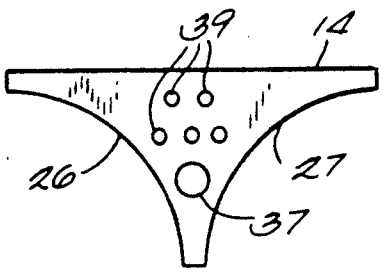

Although it is intended that both end deckles 14,14*a* be identical, they need not be. Deckle 14, has a plurality of perforations, which preferably take the form of drilled and tapped holes 34 which are disposed to be aligned vertically as shown. Although only three such holes are shown, there may be more or less depending on the diameter of the holes, the height of the deckle, the number of holes, the rate of flow at different levels and the consistency of the liquid coating material which is anticipated to be used in the particular installation. Also, in FIG. 5*a*, the holes might consist of a vertically extending slot 35 which might have a slidable cover, not shown, extending over part or all of the slot to open the slot from the bottom to any desired height. FIG. 5*b* illustrates how the openings in the deckle might be configured to control the flow pattern at different levels in the coating pool. For example, larger openings 37 near the bottom of the deckle would permit faster lateral flow of coating material from near the nip and from near the middle of the coater in the cross-machine direction.

Figure 3:
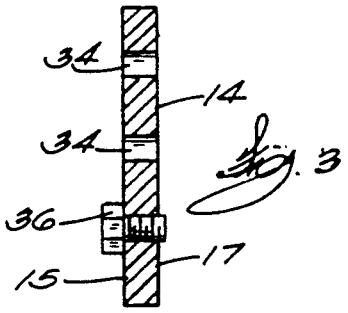
FIG. 3 is a cross-sectional elevation view of the deckle through section "A—A" in FIG. 2.

As shown in FIG. 3, a threaded plug 36 is shown disposed in the lowermost hole to close that hole and prevent stock from exiting the pool of coating liquid in the trough except for any such coating material which has a surface above either of the other remaining perforations 34. The use of a plug illustrates how one or more holes, or a patterned group of holes 39 can be closed to control the outward flow of coating liquid.

Figure 4:
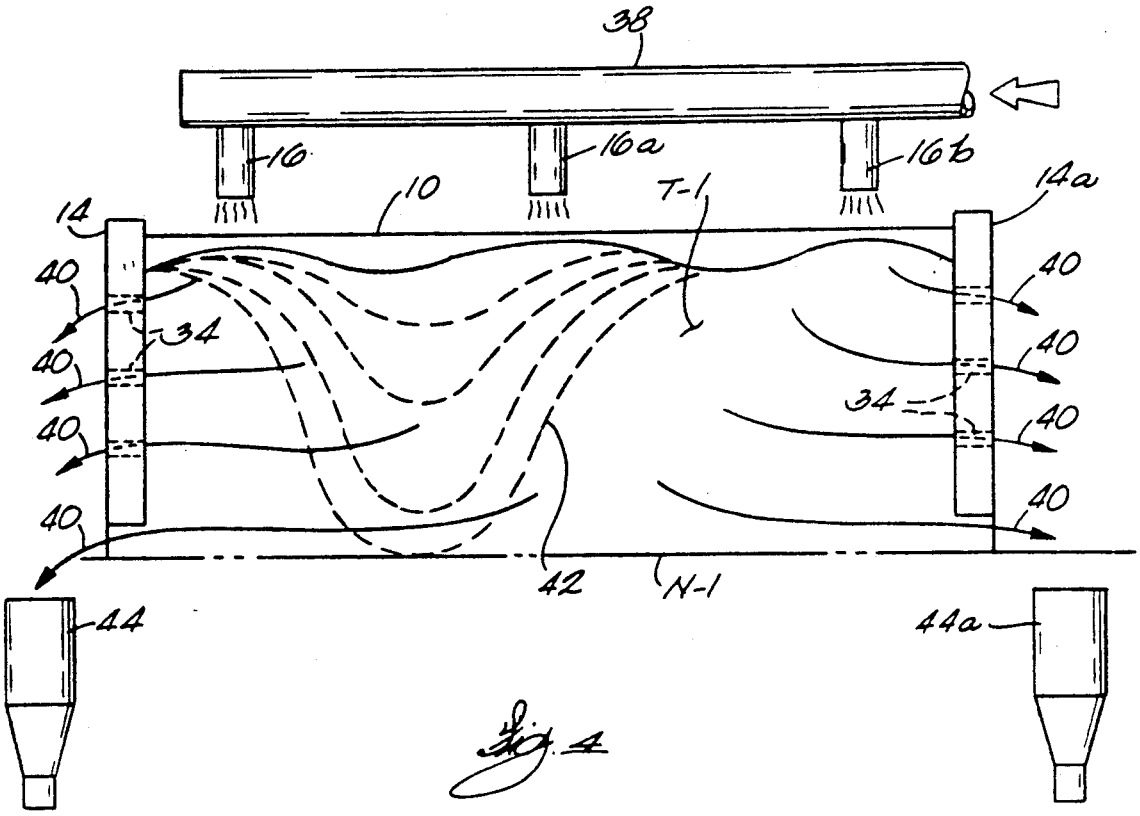
FIG. 4 is a front-elevational view of one of the metering rolls shown in FIGS. 1 and 2 and showing the surface profile of the coating pool.

FIG. 4 is a front-elevational view of the trough T-1 between rolls 10,12 with roll 12 removed for clarity. A pipe 38 extends laterally of the coater and longitudinally along the length of the trough and a supply of coating is introduced at one end thereof and discharged from one or more nozzles **16,16*a*,16*b* as shown. In the configuration shown, all of the perforations 34 in the deckles at either end of the trough are open and the aqueous coating liquid is shown exiting the trough in the direction of arrows 40. Some liquid coating escapes from the gap at the bottom of the deckles and the rotating rolls. The surface of the pool of coating is shown with an undulating profile due to the relatively large quantities of coating material being introduced into the trough and removed through the nip N-1 at the bottom. This invention operates to even out the surface profile. In some coating installations, where the depth of the trough is not very great, the lower portion of the trough 42**, shown in dashed lines, can extend down to the nip line to cause gaps and thin spots in the subsequent coating of the paper web.

In operation, with reference to FIGS. 1 and 4, the trough T-1 is filled with a pool of liquid coating material via nozzle 16, or nozzles **16,16*a*,16*b*. Metering rolls 10,12 rotate such that their surfaces travel downwardly through the pool of liquid coating material in the direction of the arrows and are nipped together at nip N-1. Since the liquid coating material passing through nip N-1 has lubricating properties, metering roll 12 can be rotated by its motor 30 faster than motor 28 rotates metering roll 10. This speed differential, which can be expressed in terms of 1:1: web speed, functions to shear the coating material and more evenly spread it on the surface of roll 12**.

The coating material on the surface of roll 12 then passes into nip N-2 between rolls 12 and 18 which are also operated at a speed differential with roll 18 traveling at a faster surface speed which corresponds with the speed of web W passing through nip N-3 between applicator rolls **18,18*a*. The speed differential between rolls 12,18 in nip N-2 functions to further meter the coating layer so that the coating layer carried by roll 18 into nip N-3 is both more uniform and of the desired thickness to coat the lower surface 20 of the paper web. The upper surface 24** of the web is coated in a similar manner with similar apparatus.

Perforations 34, which in the preferred embodiment shown in FIGS. 1 and 2 comprise a plurality of vertically arrayed holes 34, permit an outward flow of the liquid coating material from the pool to be established and maintained through the deckles, or deckle, at a desired pool depth according to the size and configuration of the perforations in conjunction with the rate at which coating material is introduced into the pool. If desired, one or more of the holes 34 can be plugged with a plug 36, such as the cap screw shown in FIG. 3, to both maintain the surface level of the pool at a desired height as well as to control the location and rate of the outward flow of coating liquid.

Referring to FIG. 4, the use of a plurality of perforations in the end deckles operates to not only maintain the liquid coating material at a desired depth in the pool and trough T-1, but the perforations 34 also operate to encourage lateral flow of the coating liquid outwardly from the trough. Such lateral, outward flow through the end deckles **14,14*a*, particularly at lower depths in the pool, tends to prevent the formation of any depressions 42 which might form in the trough T-1 due to the pool being less deep than required for the quantity of coating material used at a certain speed, or due to variations in the surface profile of one or both of nipped rolls 10,12 which might permit the rate of flow of coating material to be different at one axial location along the longitudinal length of the rolls to be different than at other locations. By encouraging lateral, outward flow of the liquid coating material from the pool at various locations at different depths, the tendency to form such depressions 42** is diminished.

In addition, such outward flow of the coating liquid from various depths of the pool functions to stabilize the pool with the attendant advantages of reducing turbulence in the pool, which might eject coating material out of the trough or pass an air bubble through the nip, as well as maintaining the surface 43 of the pool in a more placid, even condition. Such increased outward flow, as represented by arrows 40, results in increased recycling of the liquid coating material collected in edge pans **44,44*a***, but since coating material is recycled anyway, this represents no need for additional equipment.

Other embodiments for the openings in the end deckles are shown in FIGS. **5*a*,5*b*, such as vertically extending slot 35 and the plurality of holes 37,39 arranged in a configuration to set up different patterns of flow of the coating liquid from different depths of the pool, and at different rates, outwardly to more evenly distribute the coating liquid in the trough T-1** as well as to diminish turbulence.

The openings or perforations do not have to be in both deckles and do not have to be of the same configuration, or pattern of openings, in both deckles.

Thus, a method and apparatus have been shown and described which achieves the objectives and manifests the advantages of this invention. Accordingly, it will be apparent that the embodiments shown are by way of example only, and that various modifications can be made in the arrangement of the openings in the end deckles within the scope of the invention as defined by the appended claims.

What is claimed:

1. In a roll coater for coating a traveling paper web, the coater having a plurality of rolls with at least two of the rolls in nipping engagement to form a trough therebetween, and the web is directed to travel between two nipped rolls, at least one of the nipped rolls having a layer of coating on its surface, the combination comprising:

means for supplying a pool of liquid coating material to the trough between two nipped rolls;

a pair of deckles, one at either end of the pair of nipped rolls forming the trough for containing the pool of liquid coating material, and disposed to extend into the trough to maintain a pool of coating material therein;

at least one of the deckles being perforated, whereby the coating is permitted to flow through the deckle at a controlled rate from one or more predetermined depths of the pool out of the trough to control turbulence in the liquid coating material and stabilize the pool.

2. The roll coater apparatus as set forth in claim 1, wherein:

the perforation in the said at least one deckle comprises a plurality of generally vertically disposed openings.

3. The roll coater apparatus as set forth in claim 1, wherein:

the perforation in the at least one of the deckles comprises a substantially vertically extending slot.

4. The roll coater apparatus as set forth in claim 1, wherein:

the perforation comprises an opening in each of the deckles.

5. The roll coater apparatus as set forth in claim 4, wherein:

the perforation in at least one of the deckles comprises a plurality of substantially vertically arrayed openings.

6. The roll coater apparatus as set forth in claim 1, wherein:

one or both of the pair of deckles contains a plurality of perforations, at least some of the perforations being of different size.

7. In a method for coating a traveling paper web with a roll coater, the coater having a plurality of rolls with at least two of the rolls in nipping engagement, and the web is directed to travel between two nipped rolls, at least one of the nipped rolls having a layer of coating on its surface, the steps comprising:

establishing a pool of liquid coating material in a trough formed between two of the nipped rolls;

positioning a pair of deckles in the trough between two nipped rolls, one deckle near either end of the trough, to maintain the pool in the trough between the deckles;

permitting the coating material to flow through one or both of the deckles in a controlled manner from one or more depths of the pool to thereby establish and maintain a lateral flow within the pool from one or both ends of the trough to stabilize the pool and control its turbulence;

whereby the coating material applied to the surface of a roll contacting the web to be coated is of a uniform quality.

8. The method of coating a traveling paper web as set forth in claim 7, wherein:

the flow of coating material through said one or both of the deckles is controlled to be at different rates at different depths of the pool.

* * * * *